United States Patent [19]

Smith et al.

[11] Patent Number: 4,766,956

[45] Date of Patent: Aug. 30, 1988

[54] WELLHEAD ANNULAR SEAL

[75] Inventors: Jerry D. Smith, Houston; Edward J. Szymczak, Spring, both of Tex.

[73] Assignee: Cameron Iron Works USA, Inc., Houston, Tex.

[21] Appl. No.: 47,171

[22] Filed: May 7, 1987

[51] Int. Cl.[4] ..... E21B 33/03

[52] U.S. Cl. ..... 166/182; 166/208; 166/387; 277/116.2; 277/117

[58] Field of Search ..... 166/182, 208, 382, 387; 277/102, 103, 113, 116.2, 117, 236

[56] References Cited

U.S. PATENT DOCUMENTS

| | | | |
|---|---|---|---|
| 4,131,287 | 12/1978 | Gunderson et al. | 277/236 |
| 4,489,916 | 12/1984 | Stevens | 277/117 |
| 4,595,053 | 6/1986 | Watkins et al. | 277/116.2 |
| 4,665,979 | 5/1987 | Boehm, Jr. | 277/236 |
| 4,674,576 | 6/1987 | Goris et al. | 166/182 |

*Primary Examiner*—Stephen J. Novosad

*Assistant Examiner*—Terry Lee Melius

*Attorney, Agent, or Firm*—Vinson & Elkins

[57] ABSTRACT

An improved annular seal and hanger which are to be installed in a wellhead housing. The annular seal assembly includes seal ring having a central body with upper outer rim, upper inner rim, lower outer rim and lower inner rim extending from said central body, an upper wedge ring, a lower wedge ring and means connecting said rings to allow setting movement thereof, means releasably securing said assembled rings to the hanger for running into the wellhead housing, each of said rims including an outer sealing lip, the outer sealing lips having a free diameter less than the diameter of the lower wedge ring so that the sealing lips are protected during running of the hanger into the wellhead housing and means for moving said wedge rings into the space between the rims of said seal ring for urging the sealing lips into sealing engagement with the interior sealing surface of said housing.

8 Claims, 5 Drawing Sheets

WELLHEAD ANNULAR SEAL

BACKGROUND

The present invention relates to an improved annular seal assembly for use in sealing across the annulus between a wellhead housing and a hanger supported therein.

Wellhead seals have long been used to seal between the hanger and the housing in which it is supported. An example of a prior art wellhead seal is disclosed in U.S. Pat. No. 3,797,864 which provides an elastomeric ring positioned between metal end pieces having arms extending onto the inner and outer end portions of the elastomeric seal ring and means for compressing the seal axially to cause it to expand radially into sealing engagement with the inner and outer sealing surfaces.

Another type of wellhead annular seal is disclosed in U.S. Pat. No. 4,595,063 which seal includes inner and outer seal rings positioned on inner and outer surfaces of a sleeve and a U-shaped actuator which engages the ends of the seal ring to create a compression in them by virtue of relative movement between the actuator and the sleeve.

U.S. Pat. No. 4,471,965 discloses another type of seal in which an H-shaped member having arms with rounded sealing ends thereon is used for sealing across an annulus.

U.S. Pat. No. 4,178,020 discloses an H-shaped seal member with opposed wedge rings for use in a slip joint to lock the components together and provide an irreversible metal-to-metal seal.

A U-shaped seal which is wedged inward and outward into sealing engagement with the inner and outer walls of an annulus is disclosed in U.S. Pat. No. 4,595,053.

A resilient packing ring which has upper and lower legs which are actuated by wedges is disclosed in U.S. Pat. No. 1,905,122.

Another wellhead annulus sealing assembly is disclosed in U.S. Pat. No. 4,131,287. This structure includes a seal ring with two upper and two lower arms which forced into sealing position by upper and lower wedges. The assembly is connected into an assembly by bolts which extend through the wedges and into the seal ring.

SUMMARY

The improved annular seal of the present invention is to be installed in a wellhead, such as in the annulus between the wellhead housing and a hanger supported within the wellhead housing. The seal assembly which provides the metal seal of the annulus includes seal ring having a central body with upper outer rim, upper inner rim, lower outer rim and lower inner rim extending from said central body, an upper energizing ring, a lower energizing ring and means extending through said seal ring, said upper energizing ring and said lower energizing ring to retain said rings in assembled position, means releasably securing said assembled rings to a hanger for running into the wellhead housing, each of said rims including an outer sealing lip, the outer sealing lips having a free diameter less than the diameter of the lower energizing ring so that the sealing lips are protected during running of the hanger into the wellhead housing and means for moving said energizing rings into said seal ring for urging the sealing lips into sealing engagement with the interior sealing surface of said housing.

An object of the present invention is to provide an improved annular metal seal for a wellhead annulus which is protected during running and readily energized into sealing engagement.

Another object is to provide an improved wellhead annular seal which when energized causes the sealing lips to be positioned to be pressure energized seals.

A further object is to provide an improved wellhead annular metal seal which is readily unset and recovered from its sealed position within the wellhead annulus.

Another object is to provide an annular metal seal which is prestressed immediately prior to being set and energized.

BRIEF DESCRIPTION OF THE DRAWINGS

These and other objects and advantages are hereinafter set forth and explained with reference to the drawings wherein.

DESCRIPTION OF THE PREFERRED EMBODIMENT

Figure 1:
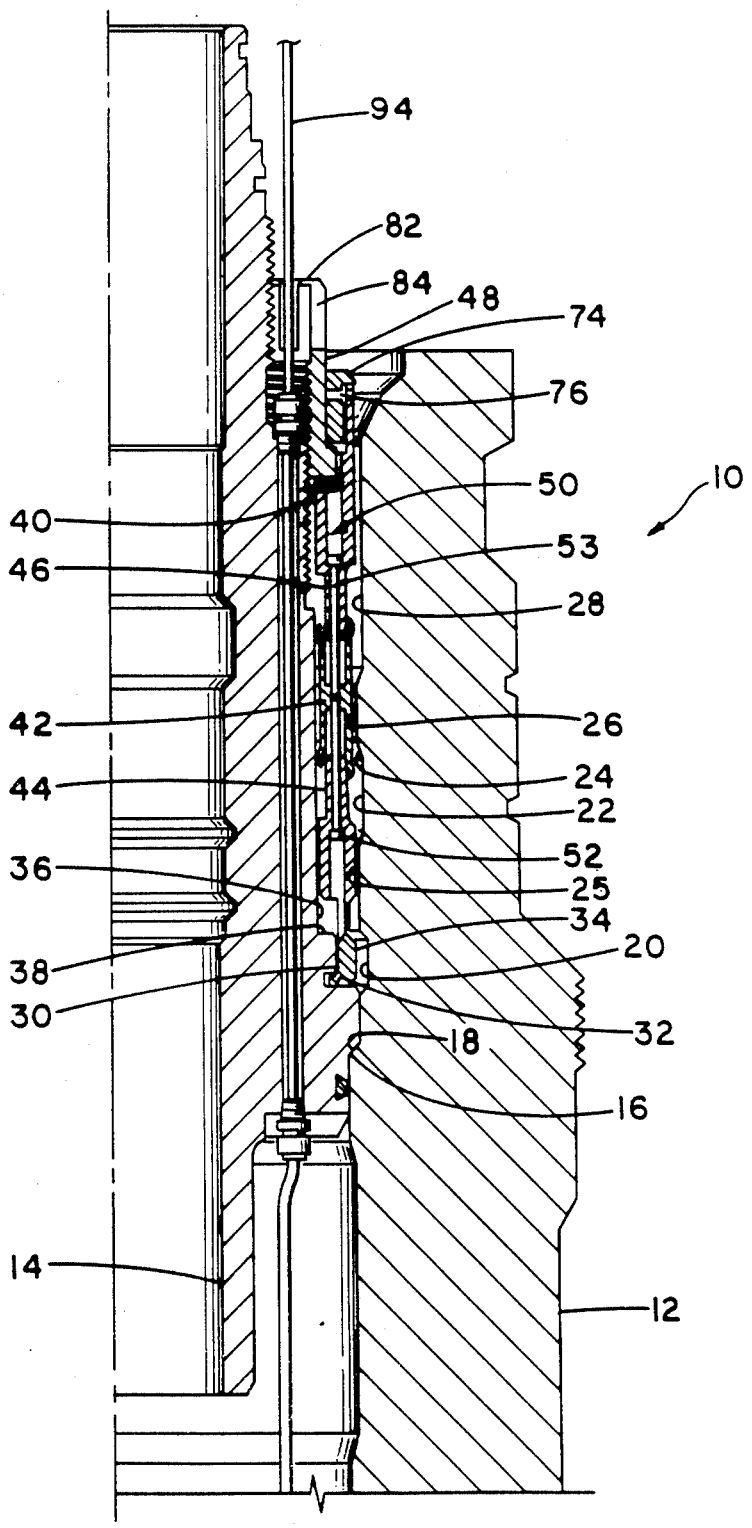
FIG. 1 discloses the improved metal annular seal being run into a wellhead housing on a hanger.

Improved annular seal assembly 10 is utilized in a wellhead to seal across the annulus between the interior of wellhead housing 12 and the exterior of tubular hanger 14. Hanger 14 is landed with its outer shoulder 16 on internal seat 18 of housing 12. The interior of housing 12 above seat 18 includes latching groove 20, groove 22 with sealing surface 25 between such grooves 20 and 22, tapered ridge 24 on the upper end of groove 22 with its interior being sealing surface 26 and inner surface 28 above ridge 24 which inner surface 28 has the same diameter as the diameter of groove 22. Sealing surfaces 25 and 26 are at the same diameter.

The exterior of hanger 14 above shoulder 16 is recessed at 30 to provide shoulder 32 on which latching means, such as split latching ring 34 is supported, second recess 36 providing shoulder 38 at the level of the upper part of latching ring 34 and the upper exterior of hanger 14 includes threads 40.

Improved seal assembly 10 includes annular seal 42, lower wedge ring 44, upper wedge ring 46, actuating ring 48 and means 50 for retaining seal assembly 10 as assembled. Such means 50 includes cap screws 52 and 53 which extend through wedge rings 44 and 46 and thread into holes **52*a* and 53*a* in the central portion of seal 42. Cap screw threaded holes 52*a* and 53*a* must not be in communication with one another. In some situations it may be preferred to radially stagger holes 52*a* and 53*a*** rather than have them radially aligned as shown in the drawings.

Figure 2:
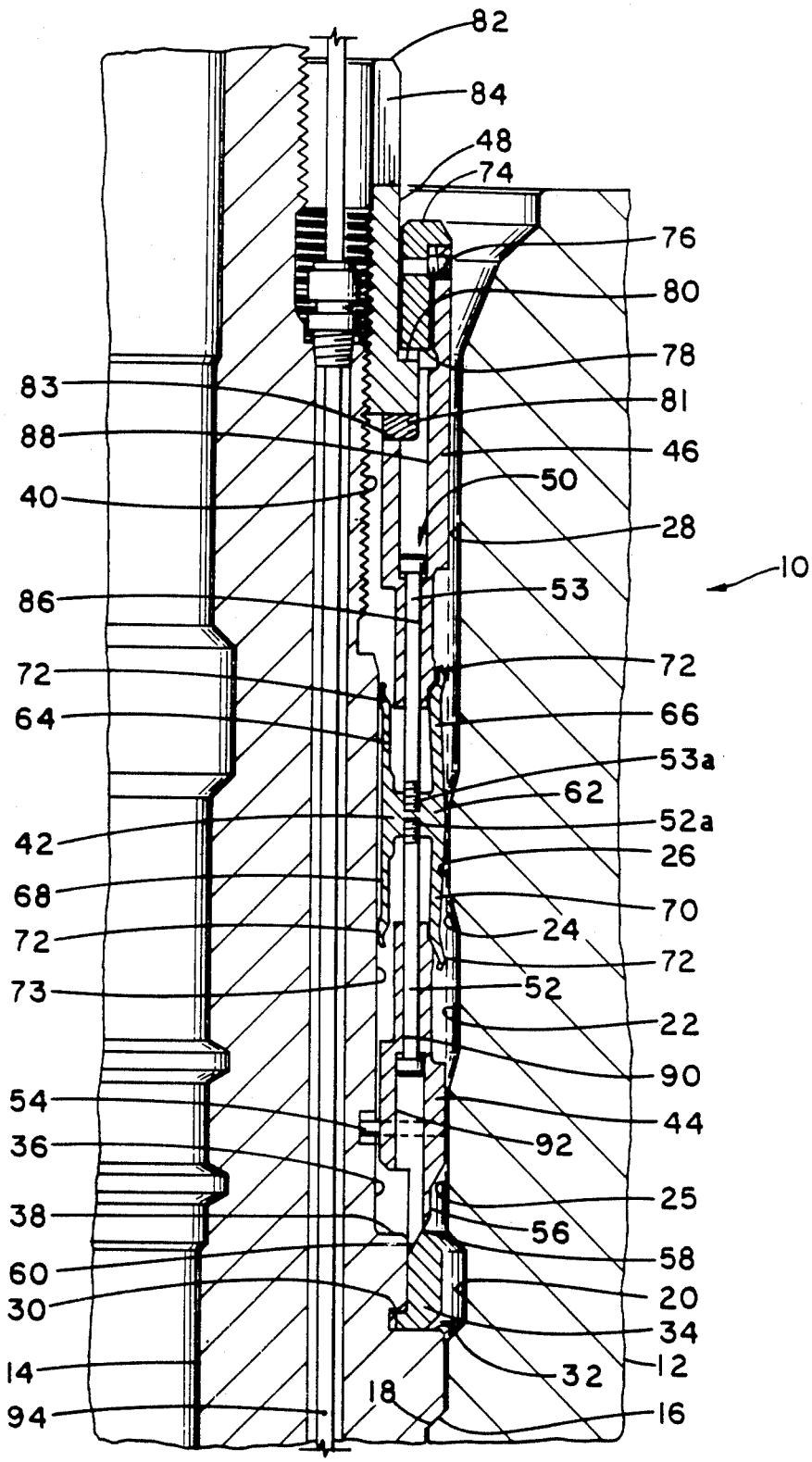
FIG. 2 is a detailed sectional view of the improved seal as the hanger is landed in its position within the wellhead housing.

Seal assembly 10 when assembled is installed on the exterior of hanger 14 in the position shown in FIGS. 1 and 2 and shear pin 54, which extends through lower wedge ring 44, prevents inadvertent downward movement of lower wedge ring 44 with respect to hanger 14.

Actuating ring 48 is threaded onto threads 40 on the exterior of hanger 14. Sleeve 56 is integral with lower wedge ring 44 and extends downwardly into position so that its lower tapered surface 58 which tapers downwardly and inwardly is in engagement with upper tapered surface 60 of split latching ring 34.

Annular seal 42 includes central ring 62 with upper inner and outer rims 64 and 66 and lower inner and outer rims 68 and 70 extending therefrom. The ends of each of the rims 64, 66, 68 and 70 are formed into arcuate lips 72. Lips 72 on outer rims 66 and 70 are curved to present a curved convex surface for sealing against sealing surfaces 25 and 26 on the interior of housing 12 as hereinafter set forth. Lips 72 on inner rims 64 and 68 are curved to present a curved convex surface for sealing against sealing surface 73 on the exterior of hanger 14 above shear pin 54.

The interengagement between actuating ring 48 and upper wedge ring 46 for the lifting of annular seal 10 is provided by retainer ring 74 which is secured within the upper interior of upper wedge ring 46 by a plurality of set screws 76. Lower surface 78 of retainer ring 74 is positioned above outer shoulder 80 on actuating ring 48. The upper rim 82 of actuating ring 46 is provided with slots 84 which can be engaged by a suitable tool (not shown) to cause rotation of actuating ring 48 with respect to hanger 14. Bearing ring 81 is interposed between the lower surface of actuating ring 48 and shoulder 83 which forms the upper interior surface of upper wedge ring 46.

Upper wedge ring 46 includes a plurality of bores 86 extending therethrough to receive cap screws 53 and counterbores 88 which are sufficiently large to receive the heads of cap screws 53. Lower wedge ring 44 includes a plurality of bores 90 extending therethrough to receive cap screws 52 and counterbores 92 which are sufficiently large to receive the heads of cap screws 52 as shown in FIG. 2. Control lines 94 extend through hanger 14 to the subsurface safety control valves (not shown).

In the running position as shown in FIGS. 1 and 2, outer lips 72 have a diameter less that the outer diameter of wedge rings 44 and 46. Inner lips 72 are in sealing engagement with sealing surface 73. The outer surface of both wedge rings 44 and 46 have a reduced diameter at their ends which are in engagement with the interior of lips 72 on outer rims 66 and 70. In this structure the wedge rings 44 and 46 serve to support rims 66 and 70 during running without causing them to be wedged outward from their desired free position.

Figure 3:
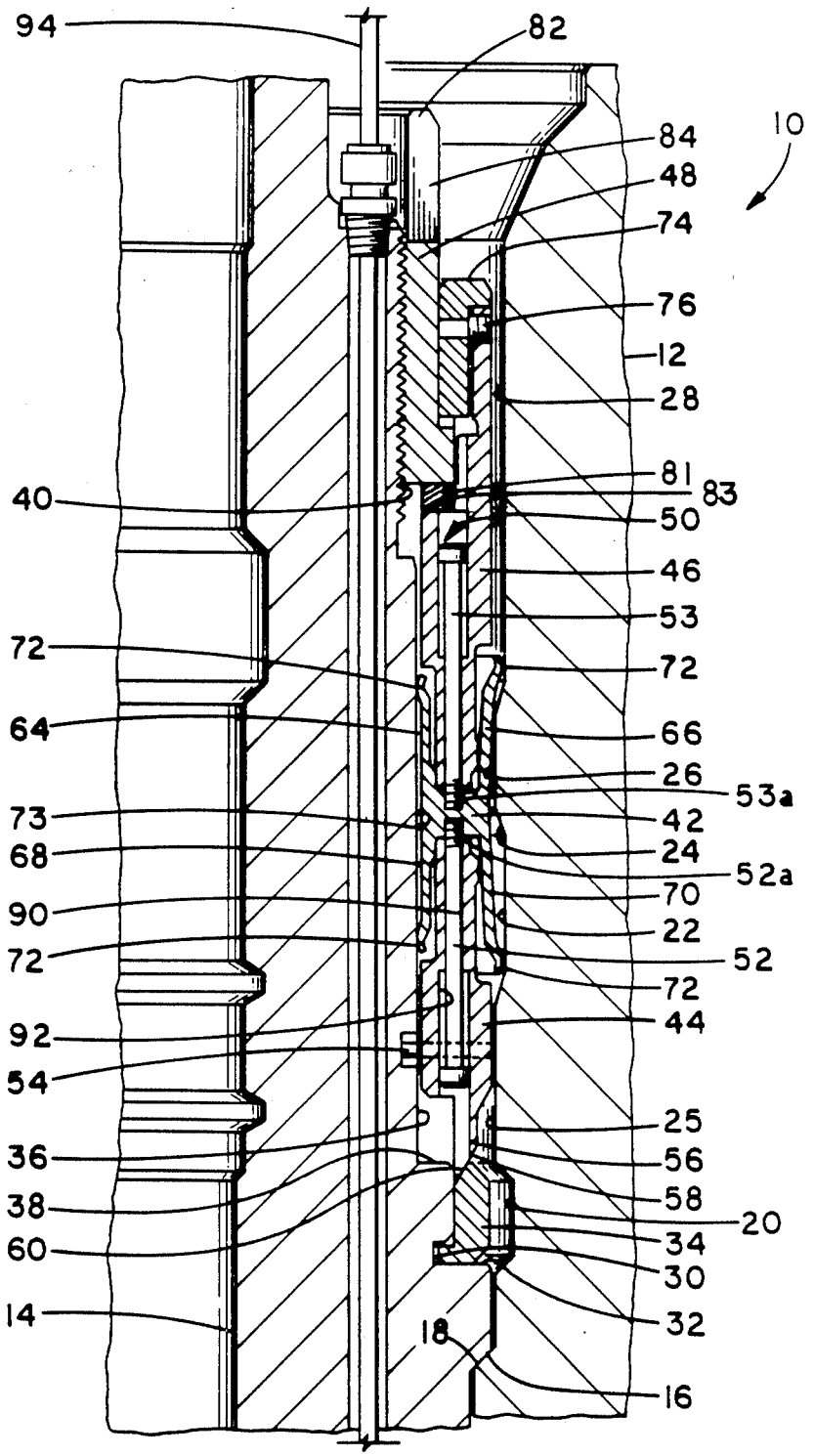
FIG. 3 is another detailed sectional view of the improved seal in its prestressed partially set position.
Figure 4:
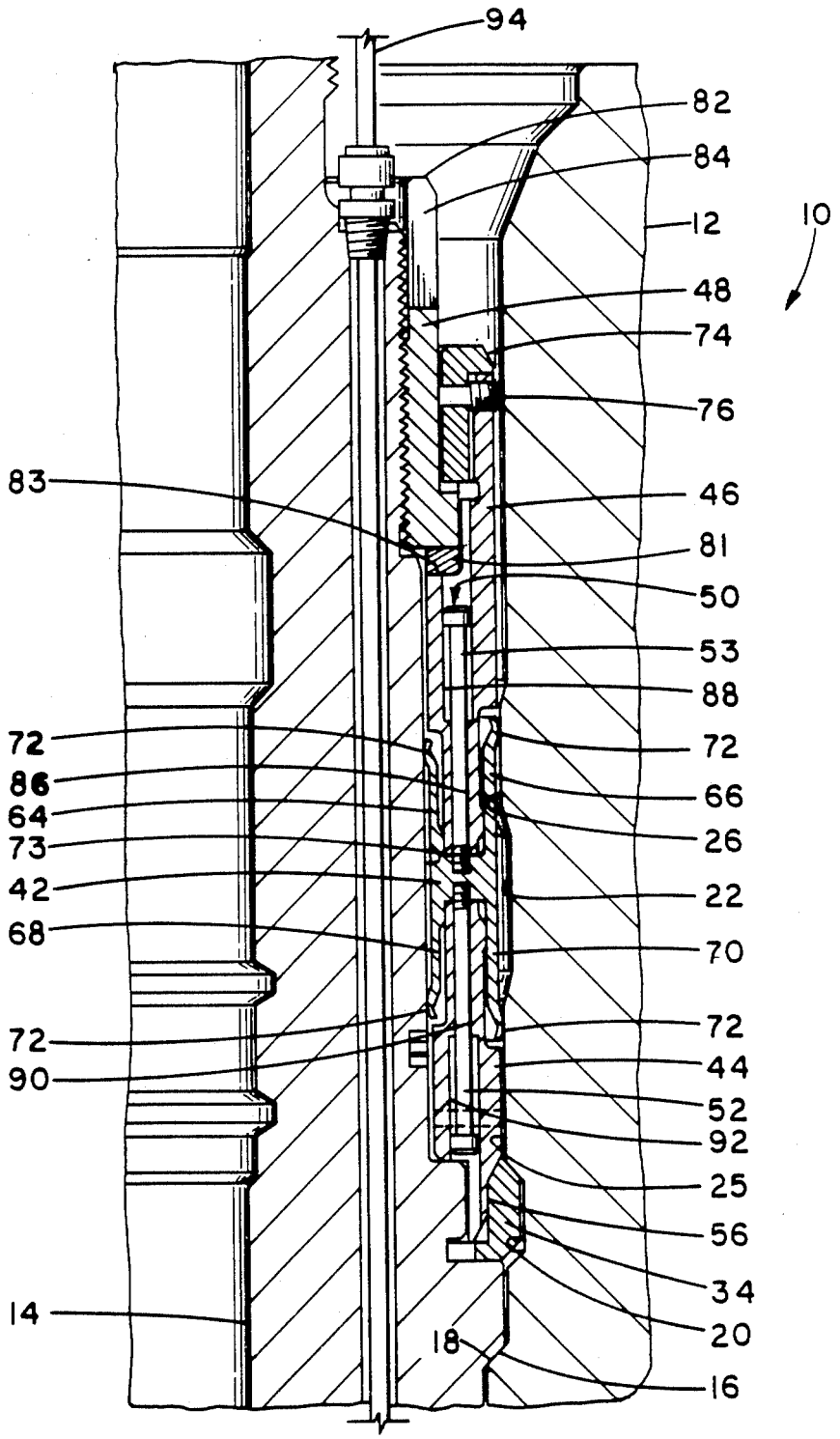
FIG. 4 is another detailed sectional view of the improved seal in its set position.

After hanger 14 has landed with its shoulder 16 seated on seat 18, a suitable tool (not shown), which could be the running tool, is engaged within slots 84 in upper rim 82 of actuating ring 48 and is rotated to cause the threading of ring 48 downward on threads 40 of hanger 14. This downward movement causes wedge rings 44 and 46 to be moved inward into annular seal 42 to the position shown in FIG. 3. It should be noted in this position that lips 72 on rims 66 and 70 have been wedged outward but are at a level so that they are adjacent upper surface 28 and groove 22. In this manner rims 66 and 70 are effectively prestressed prior to being set. The movement of the wedge rings 44 and 46 into the space between the rims also causes inner rims 64 and 68 to be wedged into tighter engagement with sealing surface 73. Further movement of actuating ring 48 causes the shearing of shear pin 54. This allows further downward movement of annular seal 10 to move sleeve 56 behind latching ring 34 so that it moves into groove 20 and secures hanger 14 in its seated position as shown in FIG. 4. Additionally, lips 72 on rims 66 and 70 are moved into tight sealing engagement with surfaces 26 and 25, respectively to complete the setting of annular seal 10 into position forming a tight metal-to-metal sealing engagement across the annular space between the hanger 14 and the interior of the housing 12.

Figure 5:
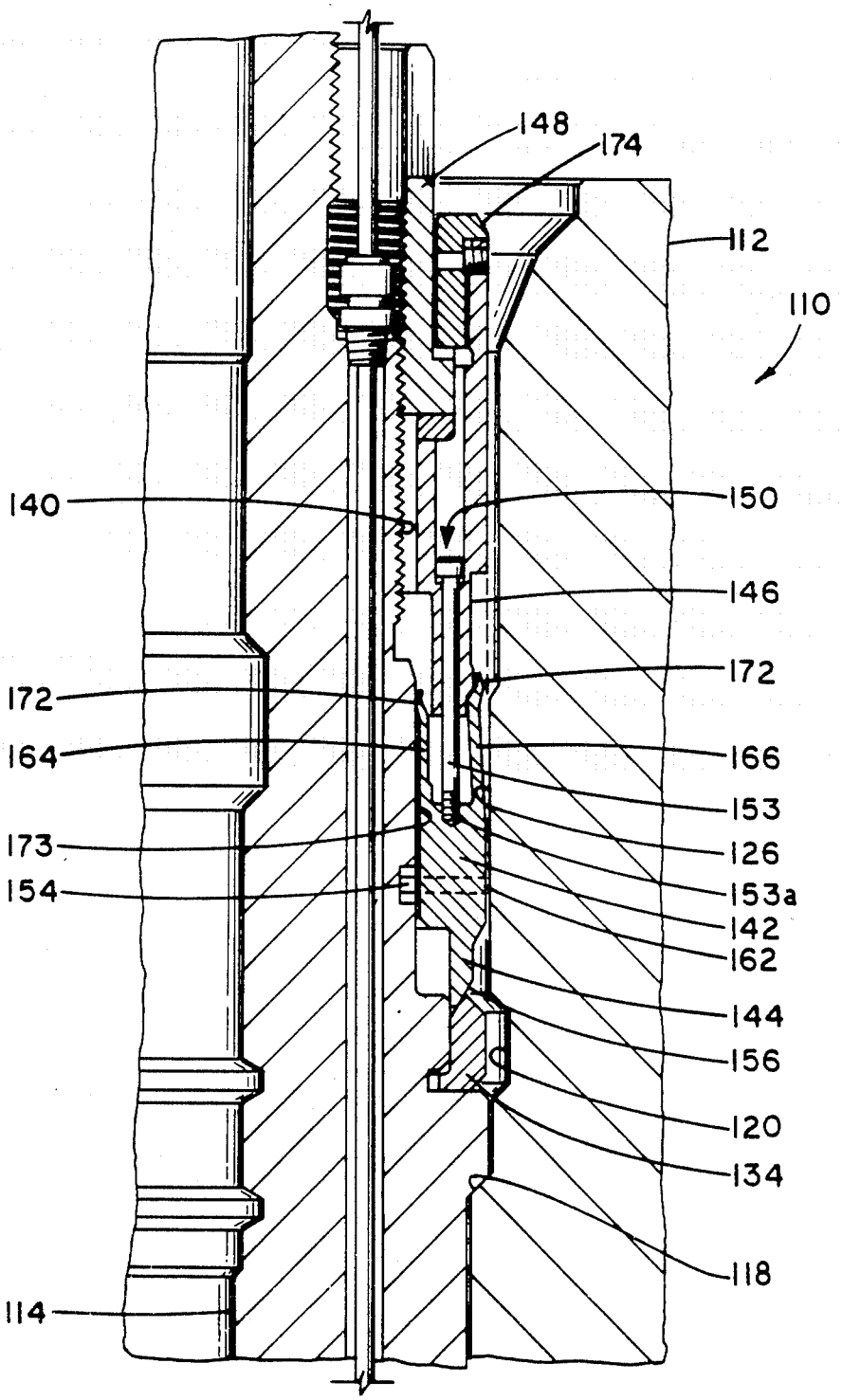
FIG. 5 is a detailed sectional view of a modified form of the improved seal as landed.

The modified form of the seal illustrated in FIG. 5, is substantially the same as the form previously discussed and for that reason, the numbering of components which are not changed are kept the same with the addition of the prefix 1. Sealing assembly 110 is supported on hanger 114 with actuating ring 148 threaded onto the external threads 140 on hanger 114 and shear pin 154 releasably secures lower wedge ring 144 to hanger 114. Cap screws 153 provide the means 150 for retaining the components of seal assembly 110 together by extending through upper wedge ring 146 and threading into annular seal 142. Annular seal 142 includes upper inner and outer rims 164 and 166 but the lower rims shown in the previous embodiment are omitted. Annular seal 142 includes sleeve 156 since the omission of the lower rims eliminates the need for the lower wedge ring. The operation of modified sealing assembly 110 is similar to sealing assembly 10 except that the lower rims are eliminated. With the prestressing of upper rims 164 and 166, additional movement of actuator ring 148 causes shearing of shear pins 154 and sleeve 156 moves downward within latching ring 134 to force it outward into latching engagement within latching groove 120 on the interior of housing 112. This effectively latches hanger 114 in its landed posi&ion within housing 112. The outer diameter of rim 166 is less than the diameter of central ring 162 of seal 142 and the diameter of upper wedge ring 146 to ensure that there is no possibility of the rims catching on the interior of the bore through which they are run before landing on housing seat 118. An additional change in this modified form of the invention is the interior profile of housing 112 which includes only sealing surface 126 and against which lip 172 of rim 166 seals. The setting of the modified form of the invention is as described above with the lips 172 of rims 164 and 166 being initially wedged outwardly and when they are in their outermost positions, the force increases against shear pin 154 until it shears allowing the assembly to move downwardly to set split latching ring 134 within groove 120. This final downward movement brings both lips 172 into sealing engagement with sealing surface 126 and sealing surface 173 to complete the metal-to-metal seal across the annulus between the exterior of hanger 114 and the interior of housing 112.

What is claimed is:

1. An annular seal for sealing across the annular space between a wellhead housing and a hanger positioned within the housing comprising an annular seal ring having a central ring with upper inner and outer rims and lower inner and outer rims, the upper inner and outer rims being spaced apart and the lower inner and outer rims being spaced apart, an upper wedge ring having a portion thereof projecting into the space between the upper rims and being wider than such space so that when moved fully into the space between the rims it wedges the rims outwardly for sealing engagement with inner and outer surfaces, a lower wedge ring having a portion thereof projecting into the space between the lower rims and being wider than such space so that when moved fully into the space between the rims it wedges the rims outwardly for sealing engagement with inner and outer surfaces, the free outer diameter of the sealing portions of said outer rims having a diameter less than the outer diameter of said lower wedge rings, means coacting with said seal ring and said wedge rings to retain said rings in assembled position, an actuating ring interengaged with said upper wedge ring and movable to provide a relative movement between said wedge rings and said seal ring and also to provide movement of said wedge rings and said seal ring into their ultimate sealing positions, and means for releasably securing said annular seal to said hanger until said rims are in their sealing position and then to release to allow movement of the annular seal on said hanger to position said rims against their respective sealing surfaces on said hanger and said wellhead housing.

2. A wellhead comprising a wellhead housing having an internal landing seat, a first sealing surface above said landing seat, a groove above said first sealing surface, a second sealing surface above said groove and an upper surface above said second sealing surface having a diameter greater than that of said second sealing surface, a hanger having an outer lower landing shoulder, which when landed is in engagement with said internal landing seat in said wellhead housing, an upwardly facing external shoulder above said landing seat, external threads on the upper exterior of said hanger and a sealing surface between said external shoulder and said threads, a seal ring having upper inner and outer rims and lower inner and outer rims with annular spaces between each pair of said inner and outer rims, an upper wedge ring having an annular depending element with its end positioned between the upper ends of said upper rims, a lower wedge ring having an annular upstanding element with its end positioned between the lower ends of said lower rims, means connecting said seal ring, said upper wedge ring and said lower wedge ring together as an assembly without restricting the movement of said wedge rings toward said seal ring, an actuating ring threaded onto said hanger and engaging the upper portion of said upper wedge ring and having means for being engaged by rotating means for axial movement of said actuating ring on said hanger threads responsive to the rotation of said actuating ring, and means securing said lower wedge ring to said hanger with sufficient strength to allow completion of setting movement of said wedge rings into said seal ring responsive to movement of said actuating ring without releasing said securing means, said securing means releasing responsive to continued movement of said actuating ring following completion of the setting movement of said wedge rings into said seal ring.

3. A wellhead according to claim 2 wherein said releasable securing means includes a shear pin extending through said lower wedge ring and into said hanger.

4. A wellhead according to claim 2 wherein the free outer diameter of the outer sealing ends of said outer rims are smaller in diameter than the outer diameter of said upper and said lower wedge rings.

5. A wellhead according to claim 2 including a retaining means comprising a plurality of cap screws extending through said upper and said lower wedge rings and threading into said seal ring to retain said rings together without restricting the setting movement of said wedge rings into said seal ring.

6. A apparatus for landing and sealing within a wellhead housing comprising a hanger having a lower external landing shoulder for landing on a seat within a wellhead housing, a seal assembly including an H-shaped seal ring with upper and lower inner and outer rims with sealing lips on the ends of each said rims, an upper wedge ring projecting between the lips of said upper rims, a lower wedge ring projecting between the lips of said lower rims, means for releasably securing the seal assembly to said hanger, said securing means having sufficient strength to allow complete setting movement of the seal assembly before release, the free outer diameter of the sealing lips on the outer rims being less than the outer diameters of said wedge rings, and means for moving said wedge rings into set position and to continue movement to bring said sealing lips of the seal assembly into sealing engagement across the annular space between the hanger and the interior of the housing in which the hanger is to be seated.

7. An annular seal for sealing across the annular space between a wellhead housing and a hanger positioned within the housing comprising an annular seal ring having a central ring with a first pair of seal ring rims extending axially therefrom and spaced apart radially, a second pair of seal ring rims extending axially from said seal ring in the opposite direction from said first pair of seal ring rims, and a first wedge ring having a rim projecting into the space between said first pair of seal ring rims, a second wedge ring having a rim projecting into the space between said second pair of seal ring rims, the outer seal ring rim having a free diameter less than the outer diameter of said first wedge rings, an actuating ring for moving said first wedge ring relative to said annular seal ring to move said projecting first wedge ring rim fully between said first pair of seal ring rims to wedge said first pair of seal ring rims apart into tight metal-to-metal sealing engagement with the walls of said hanger and wellhead housing, and for moving said second wedge ring rim fully between said second pair of seal ring rims to wedge said second pair of seal ring rims apart into tight metal-to-metal sealing engagement with the walls of said hanger and wellhead housing, means for retaining said wedge rings and said seal ring together, and means for releasably securing said annular seal to said hanger until all of said seal ring rims are in their sealing position and then to release to allow movement of the annular seal on said hanger to position all of said seal ring rims against their respective sealing surfaces on said hanger and said wellhead housing.

8. An annular seal according to claim 1 or 7 wherein said releasable securing means includes a shear pin connecting one of said wedge rings to said hanger.

* * * * *